US010259474B2

(12) United States Patent
Bieker

(10) Patent No.: US 10,259,474 B2
(45) Date of Patent: Apr. 16, 2019

(54) RUNNING GEAR FOR A RAIL VEHICLE

(71) Applicant: Bombardier Transportation GmbH, Berlin (DE)

(72) Inventor: Guido Bieker, Kirchhundem (DE)

(73) Assignee: BOMBARDIER TRANSPORTATION GMBH, Berlin (DE)

( * ) Notice: Subject to any disclaimer, the term of this patent is extended or adjusted under 35 U.S.C. 154(b) by 373 days.

(21) Appl. No.: 14/916,925

(22) PCT Filed: Sep. 9, 2014

(86) PCT No.: PCT/EP2014/069216
§ 371 (c)(1),
(2) Date: Mar. 4, 2016

(87) PCT Pub. No.: WO2015/032991
PCT Pub. Date: Mar. 12, 2015

(65) Prior Publication Data

US 2016/0214628 A1 Jul. 28, 2016

(30) Foreign Application Priority Data

Sep. 9, 2013 (CN) ..... 2013 2 0558807 U

(51) Int. Cl.
*B61F 5/50* (2006.01)
*B61F 3/04* (2006.01)

(52) U.S. Cl.
CPC . *B61F 5/50* (2013.01); *B61F 3/04* (2013.01)

(58) Field of Classification Search
CPC ..... B61F 3/08; B61F 5/50; B61C 9/48; B61C 9/50
See application file for complete search history.

(56) References Cited

U.S. PATENT DOCUMENTS 2,056,217 A 10/1936 Stout
2,263,310 A 11/1941 Piron
(Continued)

OTHER PUBLICATIONS

Cedric Zanutti, Bombardier Flexx, Urban 3000—die ultimative Drehgestellplattform für den innerstädtischen Verkehr, vol. 137, No. 6/7, Jun. 1, 2013, pp. 238-241. This reference was cited in the International Search Report and Written Opinion for Application No. PCT/EP2014/069216, dated Nov. 28, 2014, and was cited as being representative of the general state of the art which is not considered to be of particular relevance.
(Continued)

*Primary Examiner* — Zachary L Kuhfuss
(74) *Attorney, Agent, or Firm* — Nathan S. Smith; Morgan, Lewis & Bockius LLP

(57) ABSTRACT

The present invention relates to a running gear of a rail vehicle defining a longitudinal direction, a transverse direction and a height direction, the running gear comprising a first wheel unit (103.1) and a second wheel unit (103.2) defining a wheel unit axle distance, a running gear frame (104) supported on the first wheel unit (103.1) and the second wheel unit (103.2), and a first drive unit (107.1) driving the first wheel unit (103.1). The first drive unit (107.1) comprises a first reaction moment support unit (110) connected to the running gear frame (104) at a first support location to balance a drive moment exerted onto the first wheel unit (103.1) by the first drive unit (107.1). The first support location, in the transverse direction, is laterally offset from a center of the running gear frame (104). The first support location, in the longitudinal direction, is located at a first support location distance from a first wheel unit axle of the first wheel unit (103.1), which is at least 35% of the wheel unit axle distance.

18 Claims, 2 Drawing Sheets

(56) References Cited

U.S. PATENT DOCUMENTS

| | | | | | |
|---|---|---|---|---|---|
| 3,022,748 | A | | 2/1962 | Lich | |
| 4,130,065 | A | * | 12/1978 | Susdorf | B61C 9/50 105/131 |
| 4,273,055 | A | * | 6/1981 | Borgeaud | B61F 5/02 105/190.2 |
| 4,278,027 | A | * | 7/1981 | Eichinger | B61C 9/50 105/117 |
| 4,409,904 | A | * | 10/1983 | Eichinger | B61C 9/44 105/131 |
| 2010/0132585 | A1 | | 6/2010 | Rodet et al. | |

OTHER PUBLICATIONS

International Search Report and Written Opinion for Application No. PCT/EP2014/069216, dated Nov. 28, 2014, 12 pages.
Russian Office Action from Russian Patent Application No. 2016113550, dated Apr. 4, 2018, 13 pages.

* cited by examiner

RUNNING GEAR FOR A RAIL VEHICLE

BACKGROUND OF THE INVENTION

The present invention relates to a running gear of a rail vehicle defining a longitudinal direction, a transverse direction and a height direction, the running gear comprising a first wheel unit and a second wheel unit defining a wheel unit axle distance, a running gear frame supported on the first wheel unit and the second wheel unit, and a first drive unit driving the first wheel unit. The first drive unit comprises a first reaction moment support unit connected to the running gear frame at a first support location to balance a drive moment exerted onto the first wheel unit by the first drive unit. The first support location, in the transverse direction, is laterally offset from a center of the running gear frame. The present invention further relates to a rail vehicle comprising such a running gear.

In such running gears, the reaction moment necessary to be exerted on the drive unit to balance the positive moment (e.g. when accelerating) or negative moment (e.g. during regenerative braking) exerted by the drive unit onto the wheel unit, typically is introduced into the drive unit via a corresponding support linkage pivotably connected to both the running gear frame and the drive unit in order to be able to take up relative motion between the wheel unit and the running gear frame.

However, such running gears typically experience the disadvantage that, due to the lateral offset of the support location with respect to the running gear center, the reaction force (generating the reaction moment) acting on the running gear frame causes a rolling moment acting on the running gear frame about a rolling axis parallel to the longitudinal direction. Hence, the running gear frame resiliently supported on the wheel units, depending on the actual torque transmitted between the drive unit and the wheel unit, experiences a rolling moment which changes over time. Such a varying rolling moment acting on the running gear frame causes unfavorable running properties or unfavorable dynamic properties of the running gear.

SUMMARY OF THE INVENTION

Thus, it is the object of the present invention to provide an arrangement, which does not show the disadvantages described above, or at least shows them to a lesser extent, and which, in particular, provides, in a simple manner, improved running behavior and improved dynamic properties of the running gear of a rail vehicle.

The above objects are achieved starting from a running gear unit according to the preamble of claim 1 by the features of the characterizing part of claim 1.

The present invention is based on the technical teaching that, the rolling moment introduced into the running gear frame via the reaction moment support unit may be greatly reduced if the longitudinal distance (i.e. the distance in the longitudinal direction) of the support location with respect to rolling axis of the wheel unit is increased. This increase of the longitudinal distance between the support location and the axis of the wheel unit, increases the moment arm of the reaction force generating the reaction moment, such that the reaction force necessary to generate a specific reaction moment decreases. As a consequence, the rolling moment generated by this reduced reaction force on the running gear frame, in a beneficial manner, decreases as well.

Hence, according to one aspect, the present invention relates to a running gear of a rail vehicle defining a longitudinal direction, a transverse direction and a height direction, the running gear comprising a first wheel unit and a second wheel unit defining a wheel unit axle distance, a running gear frame supported on the first wheel unit and the second wheel unit, and a first drive unit driving the first wheel unit. The first drive unit comprises a first reaction moment support unit connected to the running gear frame at a first support location to balance a drive moment exerted onto the first wheel unit by the first drive unit. The first support location, in the transverse direction, is laterally offset from a center of the running gear frame. The first support location, in the longitudinal direction, is located at a first support location distance from a first wheel unit axle of the wheel unit, which is at least 35% of the wheel unit axle distance.

It will be appreciated that the rolling moment acting on the running gear frame as a result of the reaction force introduced at the support location further decreases with increasing first support location distance. Hence, preferably, the first support location distance is at least 50%, preferably at least 75%, more preferably 75% to 90% of the wheel unit axle distance. It will be appreciated, however, that with other embodiments of the invention even higher support location distance his may be chosen. In particular, the support location distance may even exceed the wheel unit axle distance.

The drive unit may be of any desired and suitable type generating a suitable (braking or acceleration) torque to be exerted on the wheel unit. Preferably, the first drive unit comprises a first gear unit and a first motor unit, the first reaction moment support unit being connected to the first gear unit.

The first reaction moment support unit may be connected in any suitable way to the gear unit. Preferably, the first reaction moment support unit is connected to the first gear unit via at least two connection locations, in order to provide proper support for the reaction moment. Preferably, the connection locations spaced from each other to provide such proper support with comparatively low support forces. Particularly simple and space-saving introduction of the reaction moment may be achieved if the two connection locations are mutually spaced in the height direction.

The first reaction moment support unit may be of any suitable design. For example, it may be composed of one or more generally bar shaped elements. Preferably, the first reaction moment support unit is a substantially plate shaped element. With such a substantially plate shaped element a particularly simple but effective transmission or support of the reaction moment may be achieved.

Preferably, the plate shaped element forming the first reaction moment support unit defines a plane of main extension which, in a rest state of the running gear standing on a straight level track, extends in a plane which is substantially parallel to the longitudinal direction and the height direction. Since this plane of main extension, in this rest state, is substantially perpendicular to the axis of the wheel unit, the reaction moment is substantially acting in the plane of main extension of the first reaction moment support unit. Hence, a comparatively thin plate shaped element is sufficient to provide proper support of the reaction moment.

With further preferred embodiments of the invention of particularly simple design, the first reaction moment support unit is a generally L-shaped element with a short shank and a long shank. Preferably, the first reaction moment support unit is connected to the first drive unit at the short shank. Here, in particular, at least two connection locations may be used, wherein the connection locations may be spaced from each other in the height direction in order to provide proper support of the reaction moment in a very simple manner.

Furthermore, preferably, the first reaction moment support unit is connected to the running gear frame at a free end of the long shank. This also yields a very simple and robust configuration providing proper reaction moment support.

It will be appreciated that the reaction moment support device may have any desired distribution of its thickness (i.e. its dimension transverse to its plane of main extension). For example, the first reaction moment support device may have substantially uniform thickness over its entire length and/or width.

With further preferred embodiments of the invention, however, the first reaction moment support unit has a first end section located adjacent to the first support location, a second end section connected to the first drive unit, and a middle section located between the first end section and the second end section. In a plane perpendicular to the longitudinal direction, the first end section has a first end section thickness, the middle section has a middle section thickness, and the second end section has a second end section thickness, the middle section thickness being reduced compared to the first end section thickness and/or the second end section thickness. Hence, comparatively lightweight and space-saving configuration of the first reaction moment support unit may be achieved.

Preferably, the middle section thickness is less than 75%, preferably less than 60%, more preferably 30% to 60%, of the first end section thickness and/or the second end section thickness. In these cases, comparatively lightweight and space-saving configurations may be achieved while still maintaining the ability to transmit considerable reaction moments.

The middle section may extend over arbitrary dimensions in the longitudinal direction. Preferably, the first reaction moment support unit, in the longitudinal direction, has a first reaction moment support unit length, and the middle section, in the longitudinal direction, extends over at least 50%, preferably at least 60%, more preferably 75% to 90%, of the first reaction moment support unit length. By this means, considerable reduction in the weight and the space required by the first reaction moment support unit may be achieved.

The first reaction moment support unit may be arranged in any desired and suitable spatial relation with respect to the components of the first drive unit. Preferably, the first drive unit comprises a first gear unit and a first motor unit driving the first wheel unit via the first gear unit, the first motor unit having a substantially prismatic or cylindrical motor body section. The motor body section, in the longitudinal direction, has a motor body section length and the middle section is located adjacent to the first motor unit. The middle section, in the longitudinal direction, extends over at least 100%, preferably at least 105%, more preferably 105% to 140%, of the motor body section length. This has the advantage that the motor body section of the first motor unit may (typically laterally) protrude into the recess or depression formed by the middle section within the first reaction moment support unit, such that a very compact and space-saving arrangement may be achieved.

With preferred embodiments of the invention, the first drive unit comprises a first gear unit and a first motor unit driving the first wheel unit via the first gear unit. The first reaction moment support unit extends along the first motor unit. The first motor unit has a security catch element adapted to engage the first reaction moment support unit in case of a failure of a support of the first motor unit, in particular in the area of a drive connection between the first motor unit and the first gear unit.

With further preferred embodiments of the invention, the first drive unit comprises a first gear unit and a first motor unit driving the first wheel unit via the first gear unit. The first motor unit, at an end opposite to the first gear unit, is connected to the running gear frame via a first mounting console. The first reaction moment support unit is connected to the first mounting console at the first support location. By this means, due to the fact that the support location is placed in the area of the end of the first drive unit facing away from the first wheel unit, a considerable lever arm for the reaction force and, hence, a considerable reduction of the reaction force (for a given reaction moment to be transmitted) is achieved. Furthermore, the use of the mounting console provides a very simple and easy to manufacture interface for introduction of the reaction force into the running gear frame.

It will be appreciated that introduction of the reaction force into the running gear frame may be achieved in any suitable way. Preferably, the first reaction moment support unit is connected to the running gear frame and/or the drive unit in a laterally elastic manner. Hence, relative motion between the first drive unit and the running gear frame may be compensated in a very simple and effective manner.

It will be appreciated that the laterally offset first drive unit may be located at any desired position in the transverse direction with respect to the center of the running gear. For example, it may be located within a space defined between the two wheels of the respective wheel unit. Particularly beneficial effects of the present invention are achieved, however, in cases where the first wheel unit has two wheels defining a track width and the first drive unit, in the transverse direction, is located external to a space defined between the two wheels.

It will be appreciated that the present invention may be used in configurations where only one single drive unit is present. Preferably, however, a second drive unit is provided, the second drive unit driving the second wheel unit. The second drive unit comprises a second reaction moment support unit connected to the running gear frame at a second support location to balance a drive moment exerted onto the second wheel unit by the second drive unit. It will be appreciated that the second drive unit, in particular its reaction moment support unit, may also have all the features and functionalities as described above in the context of the first drive unit. The first and second drive unit may be of different design and arrangement. Preferably, however, the first and second drive unit, in particular, their reaction moment support units, are of substantially identical design. In particular, a substantially rotationally symmetric arrangement (typically with respect to a vertical centerline of the running gear) of the first and second drive units may be provided.

Hence, preferably, the second support location, in the transverse direction, is laterally offset from the center of the running gear frame, the second support location, in the longitudinal direction, being located at a second support location distance from a second wheel unit axle of the wheel unit, which is at least 35% of the wheel unit axle distance.

It will be appreciated that the two drive units may be arranged on the same side of the running gear frame. Preferably however, with embodiments allowing easier integration of the two drive units into the running gear, the first drive unit and the second drive unit, in the transverse direction, are located on opposite sides of the running gear frame. In such a case, preferably, a point symmetric arrangement of the two drive units is selected.

Finally, the present invention relates to a rail vehicle with a wagon body supported on a running gear according to the invention.

Further embodiments of the present invention will become apparent from the dependent claims and the following description of preferred embodiments which refers to the appended figures.

DETAILED DESCRIPTION OF THE INVENTION

Figure 1:
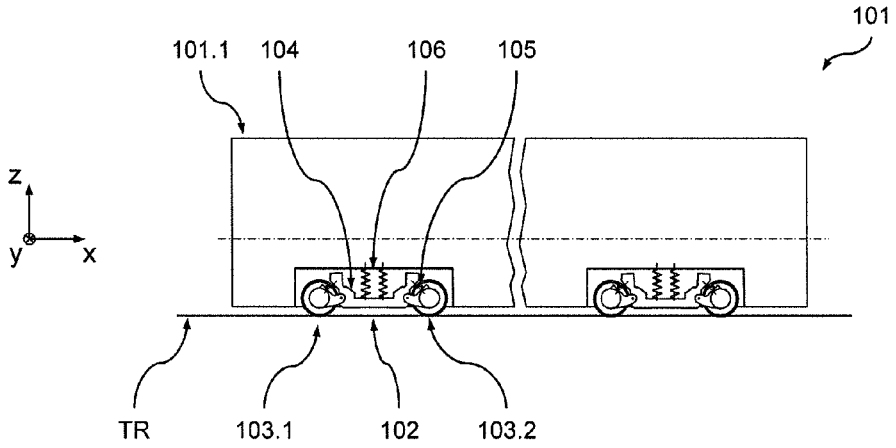
FIG. 1 is a schematic side view of a part of a preferred embodiment of a rail vehicle according to the present invention with a preferred embodiment of a running gear according to the present invention.
Figure 2:
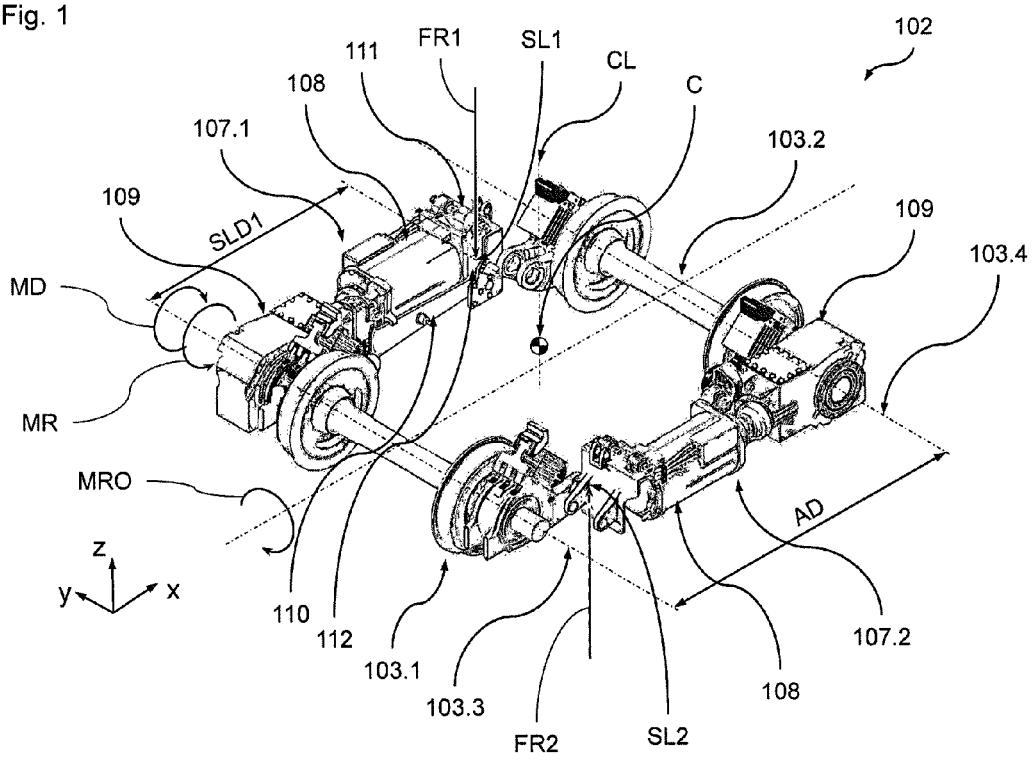
FIG. 2 is a schematic perspective view of parts of a running gear of FIG. 1.
Figure 3:
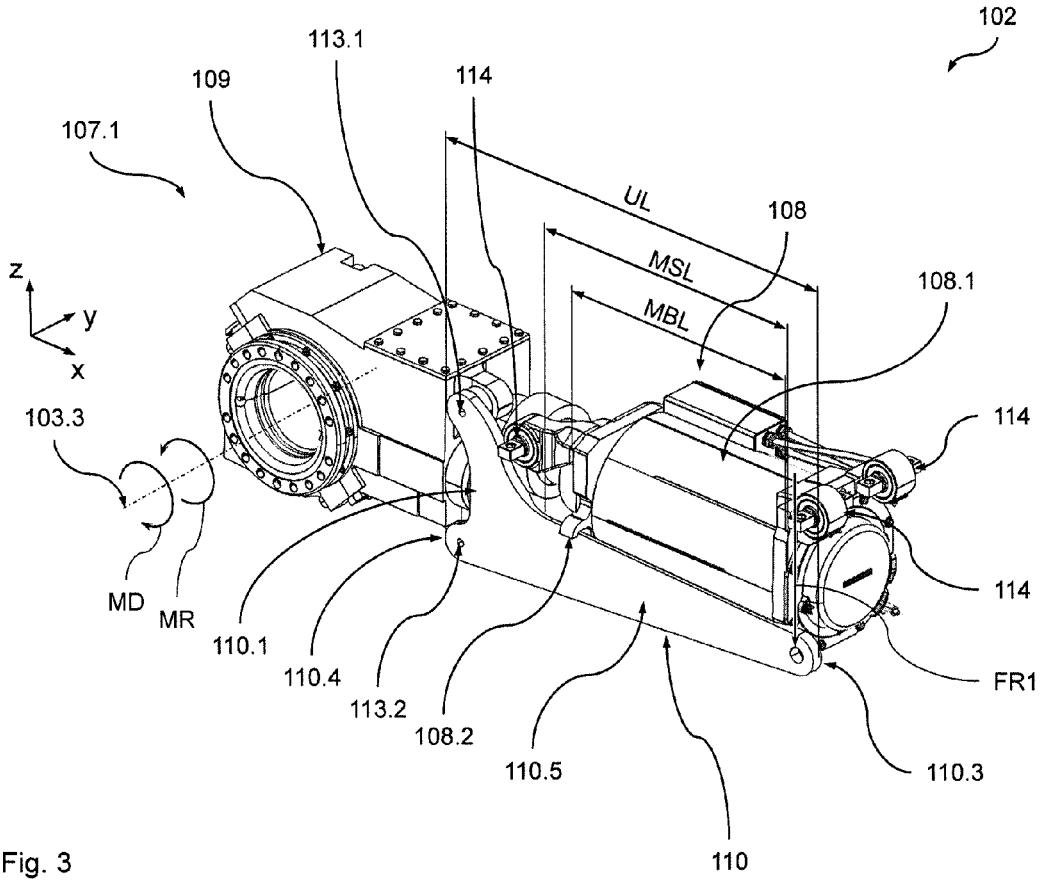
FIG. 3 is a schematic perspective view of the first drive unit of FIG. 2.

With reference to FIGS. 1 to 3 a preferred embodiment of a rail vehicle 101 according to the present invention comprising a preferred embodiment of a running gear 102 according to the invention will now be described in greater detail. In order to simplify the explanations given below, an xyz-coordinate system has been introduced into the Figures, wherein (on a straight, level track TR) the x-axis designates the longitudinal direction of the rail vehicle 101, the y-axis designates the transverse direction of the rail vehicle 101 and the z-axis designates the height direction of the rail vehicle 101 (the same, of course, applies for the running gear 102). It will be appreciated that all statements made in the following with respect to the position and orientation of components of the rail vehicle, unless otherwise stated, refer to a static situation with the rail vehicle 101 standing on a straight level track under nominal loading.

The vehicle 101 is a low floor rail vehicle such as a tramway or the like. The vehicle 101 comprises a wagon body 101.1 supported by a suspension system on the running gear 102. The running gear 102 comprises two wheel units in the form of wheel sets 103.1, 103.2 supporting a running gear frame 104 via a primary spring unit 105. The running gear frame 104 supports the wagon body via a secondary spring unit 106.

As can be seen from FIG. 2, showing a part of the running gear 102 without the running gear frame 104, the running gear 102 comprises a first wheel unit 103.1 driven by a first drive unit 107.1 and a second wheel unit 103.2 driven by a second drive unit 107.2. The first drive unit 107.1 and the second drive unit 107.2 are located on opposite lateral sides of the running gear 102 but are of substantially identical design, such that a substantially symmetric arrangement with respect to the center C of the running gear 102 is obtained. More precisely, substantial rotational symmetry is obtained with respect to a centerline CL running through the center C of the running gear 102 and being parallel to the height direction (z direction), such that the second drive unit 107.2 would result from a rotation of the first drive unit 107.1 by 180° about the centerline CL.

In the following, the features and functionality of both drive units 107.1, 107.2 will be described using the example of the first drive unit 107.1 with reference to FIGS. 2 and 3. Hence, unless explicitly otherwise stated, all statements given below relating to the first drive unit 107.1 similarly apply for the second drive unit 107.2.

As can be seen from FIG. 2, the first wheel unit 103.1 and the second wheel unit 103.2 define a wheel unit axle distance AD. The first drive unit 107.1 comprises a first motor unit 108 driving the first wheel unit 103.1 via a first gear unit 109 connected to the first motor unit 108 via a conventional clutch device.

The first drive unit 107.1 further comprises a first reaction moment support unit 110 connected to the running gear frame 104 via a first mounting console 111 at a first support location SL1 to balance a drive moment MD exerted onto the first wheel unit 103.1 by the first drive unit 107.1. The drive moment MD is balanced by a reaction force FR1 introduced into the first reaction moment support unit 110 at the first support location SL1 via a connecting linkage 112 (thereby generating a balancing moment MB balancing reaction moment MR acting on the gear unit 109). Similar applies to the second drive unit, where a reaction force FR2 generates a corresponding reaction moment.

The first support location SL1, in the transverse direction, is laterally offset from the center C of the running gear frame, while, in the longitudinal direction, the first support location SL1 is located at a first support location distance SLD1 from the first wheel unit axle 103.3 of the first wheel unit 103.1. As can be seen from FIG. 2, in the present example, the first support location distance SLD1 is about 75% of the wheel unit axle distance AD.

As had been outlined above, the rolling moment MRO acting on the running gear frame 104 (about the rolling axis parallel to the longitudinal axis, i.e. the x axis) as a result of the reaction forces FR1 and FR2 introduced at the first and second support locations SL1 and SL2, due to this comparatively long first support location distances SLD1, SLD2 is greatly reduced compared to conventional designs where the respective support location SL1, SL2 is located comparatively close to the respective wheel unit axis 103.3, 103.4.

As can be seen from FIG. 3, the first reaction moment support unit 110 is a generally L-shaped element with a short shank 110.1 and a long shank 110.2. The reaction moment support unit 110 is connected to the first gear unit 109 via two connection locations 113.1, 113.2 at the short shank 110.1 in order to provide proper support for the reaction moment MR, while the first support location SL1 is located at the free end of the long shank 110.2. The spacing of the connection locations 113.1, 113.2 in the height direction (z direction) provides proper support of the reaction moment MR at the 109 with comparatively low support forces. Furthermore the spacing in the height direction provides a particularly simple and space-saving introduction of the reaction moment into the first gear unit 109.

As can be seen, in particular, from FIGS. 2 and 3, the first reaction moment support unit 110 is a substantially plate shaped element defining a plane of main extension which, in a rest state of the running gear 102 standing on a straight level track, extends in a plane which is substantially parallel to the longitudinal direction (x direction) and the height direction (z direction). Since this plane of main extension, in this rest state, is substantially perpendicular to the axis 103.3 of the first wheel unit 103.1, the reaction moment MR is substantially acting in the plane of main extension of the first reaction moment support unit 110. Hence, a comparatively thin plate shaped element is sufficient to provide proper support of the reaction moment MR.

As can be seen, in particular, from FIG. 3, the first reaction moment support unit has a first end section 110.3 located adjacent to the first support location SL1, a second end section 110.4 connected to first gear unit 109, and a middle section 110.5 located (in the longitudinal direction) between the first end section 110.3 and the second end section 110.4.

In a plane perpendicular to the longitudinal direction, the first end section 110.3 has a first end section thickness T1, the middle section 110.5 has a middle section thickness TM, and the second end section 110.4 has a second end section thickness T2. As can be seen from FIG. 3, while the first end section thickness T1 is substantially equal to the second end section thickness 12, the middle section thickness TM is only about 50% of the first and second end section thickness T1, T2, such that a noticeable lateral depression or recess is formed in the middle section 110.5. Hence, a comparatively lightweight and space-saving configuration of the first reaction moment support unit 110 is achieved, while still maintaining the ability to transmit considerable reaction moments MR.

In the present example, the middle section 110.5, in the longitudinal direction, has a first reaction moment support unit length UL1, and the middle section, in the longitudinal direction, extends over a middle section length MSL, which is about 70% of the first reaction moment support unit length UL1. By this means, considerable reduction in the weight and the space required by the first reaction moment support unit 110 is achieved.

Furthermore, the lateral depression formed by the reduced thickness TM of the middle section 110.5 allows a very close spatial arrangement between the first reaction moment support unit 110 and the first drive unit 107.1. More precisely, the (at its longitudinal ends) partially substantially prismatic and (between its longitudinal ends) partially substantially cylindrical motor body section 108.1, in the longitudinal direction, has a motor body section length MBL. The middle section 110.5, in the longitudinal direction, extends over about 110% of the motor body section length MBL, such that the motor body section 108.1 of the first motor unit laterally protrudes into the depression formed by the middle section 110.5 within the first reaction moment support unit 110, such that a very compact and space-saving arrangement is achieved.

As can be further seen from FIG. 3, the first motor unit 108 has a substantially hook shaped security catch element 108.2 adapted to engage the first reaction moment support unit 110 in case of a failure of the support of the first motor unit 108, in particular in the area of a drive connection between the first motor unit 108 and the first gear unit 110.

As can be further seen from FIGS. 2 and 3, while the first gear unit 109 sits on the shaft of the first wheel unit 103.1, the first motor unit 108 suspended to the running gear frame by three conventionally designed, slightly laterally elastic connections formed by rubber element bearings 114. One of these bearings 114 (in the longitudinal direction) is located roughly at the level of the clutch connecting the first motor unit 108 and the gear unit 109. The other two bearings 114 are located at the end opposite to the first gear unit 109 connecting the first motor unit 108 to the running gear frame 104 via the first mounting console 111.

Although the present invention in the foregoing has only a described in the context of a non-driven running gear for low-floor rail vehicles, it will be appreciated, however, that it may also be applied to any other type running gear, as well as any other type of rail vehicle in order to overcome similar problems with respect to the reduction of rolling moments introduced into the running gear frame via reaction forces balancing the drive torque of the drive unit for the respective wheel unit.

The invention claimed is:

1. A running gear of a rail vehicle defining a longitudinal direction, a transverse direction and a height direction, said running gear comprising:

a first wheel unit and a second wheel unit defining a wheel unit axle distance;

a running gear frame supported on said first wheel unit and said second wheel unit; and a first drive unit driving said first wheel unit;

wherein said first drive unit comprises a first reaction moment support unit connected to said running gear frame at a first support location to balance a drive moment exerted onto said first wheel unit by said first drive unit, said first reaction moment support unit having a first end section located adjacent to said first support location, a second end section connected to said first drive unit, and a middle section located between said first end section and said second end section, wherein in a plane perpendicular to said longitudinal direction, said first end section, said first end section has a first end section thickness, said middle section has a middle section thickness, and said second end section has a second end section thickness, wherein said first reaction moment support unit, in said longitudinal direction, has a first reaction moment support unit length, wherein said middle section, in said longitudinal direction, extends over at least 50% of said first reaction moment support unit length, and wherein said middle section thickness is reduced compared to said first end section thickness or said second end section thickness;

wherein said first support location, in said transverse direction, is laterally offset from a center of said running gear frame; and wherein said first support location, in said longitudinal direction, is located at a first support location distance from a first wheel unit axle of said first wheel unit, which is at least 35% of said wheel unit axle distance.

2. The running gear according to claim 1, wherein said first support location distance is at least 50% of said wheel unit axle distance.

3. The running gear according to claim 2, wherein said first support location distance is at least 75% of said wheel unit axle distance.

4. The running gear according to claim 2, wherein said first support location distance is 75% to 90% of said wheel unit axle distance.

5. The running gear according to claim 1, wherein:

said first drive unit comprises a first gear unit and a first motor unit;

said first reaction moment support unit is connected to said first gear unit;

said first reaction moment support unit is connected to said first gear unit via at least two connection locations; and said connection locations, in said height direction, are spaced from each other.

6. The running gear according to claim 1, wherein:

said first reaction moment support unit is a substantially plate-shaped element defining a plane of main extension; and said plane of main extension, in a rest state of said running gear standing on a straight level track, extends in a plane which is substantially parallel to said longitudinal direction and said height direction.

7. The running gear according to claim 1, wherein:

said first reaction moment support unit is a generally L-shaped element with a short shank and a long shank;

said first reaction moment support unit is connected to said first drive unit at said short shank via at least two connection locations, said connection locations being spaced from each other in said height direction; and said first reaction moment support unit is connected to said running gear frame at a free end of said long shank.

8. The running gear according to claim 1, wherein said middle section thickness is less than 75% of said first end section thickness or said second end section thickness.

9. The running gear according to claim 1, wherein:

said first drive unit comprises a first gear unit and a first motor unit driving said first wheel unit via said first gear unit;

said first motor unit comprises a motor body section, m said longitudinal direction, has a motor body section length;

said middle section is located adjacent to said first motor unit; and said middle section, in said longitudinal direction, extends over at least I 00% of said motor body section length.

10. The running gear according to claim 9, wherein said first motor unit has a substantially prismatic or cylindrical motor body section.

11. The running gear according to claim 1, wherein:

said first drive unit comprises a first gear unit and a first motor unit driving said first wheel unit via said first gear unit;

said first reaction moment support unit extends along said first motor unit; and said first motor unit has a security catch element adapted to engage said first reaction moment support unit in case of a failure of a support of said first motor unit in an area of a drive connection between said a first motor unit and said first gear unit.

12. The running gear according to claim 1, wherein:

said first drive unit comprises a first gear unit and a first motor unit driving said first wheel unit via said first gear unit;

said first motor unit, at an end opposite to said first gear unit, is connected to said running gear frame via a first mounting console; and said first reaction moment support unit is connected to said first mounting console at said first support location.

13. The running gear according to claim 1, wherein said first reaction moment support unit is connected to said running gear frame or said first drive unit in a laterally elastic manner.

14. The running gear according to claim 1, wherein:

said first wheel unit has two wheels defining a track width; and said first drive unit, in said transverse direction, is located external to a space defined between said two wheels.

15. The running gear according to claim 1, wherein:

a second drive unit is provided, said second drive unit driving said second wheel unit; and said second drive unit comprises a second reaction moment support unit connected to said running gear frame at a second support location to balance a drive moment exerted onto said second wheel unit by said second drive unit.

16. The running gear according to claim 15, wherein:

said second support location, in said transverse direction, is laterally offset from said center of said running gear frame; and said second support location, in said longitudinal direction, is located at a second support location distance from a second wheel unit axle of said second wheel unit, which is at least 35% of said wheel unit axle distance.

17. The running gear according to claim 15, wherein said first drive unit and said second drive unit, in said transverse direction, are located on opposite sides of said running gear frame.

18. A rail vehicle with a wagon body supported on a running gear according to claim 1.

* * * * *